US006363546B1

(12) United States Patent
Mateina

(10) Patent No.: US 6,363,546 B1
(45) Date of Patent: Apr. 2, 2002

(54) SANITARY DEVICE

(75) Inventor: Ludger Mateina, Ahlen (DE)

(73) Assignee: Franz Kaldewei GmbH & Co., Ahlen (DE)

( * ) Notice: Subject to any disclaimer, the term of this patent is extended or adjusted under 35 U.S.C. 154(b) by 0 days.

(21) Appl. No.: 09/691,708

(22) Filed: Oct. 18, 2000

(30) Foreign Application Priority Data

Oct. 22, 1999 (EP) ..... 99121126

(51) Int. Cl.[7] ..... A47K 3/02
(52) U.S. Cl. ..... 4/584; 4/589; 4/592; 4/593
(58) Field of Search ..... 4/584, 585, 589, 4/592, 593, 594, 595; 52/35

(56) References Cited

U.S. PATENT DOCUMENTS

| | | | | |
|---|---|---|---|---|
| 1,882,514 A | * | 10/1932 | Martens | |
| 2,117,233 A | * | 5/1938 | Clark | |
| 2,305,846 A | * | 12/1942 | Coordes | |
| 2,697,231 A | * | 12/1954 | Strand | |
| 2,982,972 A | * | 5/1961 | Bowden | |
| 4,290,154 A | * | 9/1981 | Benjamin | 4/584 |
| 4,669,133 A | * | 6/1987 | Blecher et al. | 4/584 |
| 4,879,858 A | * | 11/1989 | Mardoch | 52/35 |
| 5,477,568 A | * | 12/1995 | Wang | 4/592 |
| 5,615,421 A | * | 4/1997 | Watkins et al. | 4/584 |
| 5,946,861 A | * | 9/1999 | Krist et al. | 52/35 |
| 5,960,489 A | * | 10/1999 | Hanel et al. | 4/584 |

FOREIGN PATENT DOCUMENTS

| | | | |
|---|---|---|---|
| DE | 36 16 421 | | 11/1987 |
| DE | 196 49 120 | | 5/1998 |
| DE | 198 01 43 | | 7/1999 |
| DE | 299 05 123 | | 7/1999 |
| GB | 1304222 | * | 1/1973 |
| GB | 2224202 A | * | 5/1990 |

* cited by examiner

*Primary Examiner*—Gregory L. Huson
*Assistant Examiner*—Khoa Huynh
(74) *Attorney, Agent, or Firm*—Collard & Roe, P.C.

(57) ABSTRACT

A sanitary device comprises a tub (2) arranged on feet (1), and a tub encasement (3). The tub encasement (3) takes the form of a supporting construction having a structure made up of panels. At least the panels (4) visible from inside a room consist of a hard integral polyurethane foam material and have a decorative coating.

11 Claims, 7 Drawing Sheets

SANITARY DEVICE

BACKGROUND OF THE INVENTION

1. Field of the Invention

The present invention relates to a sanitary device comprising a tub and a tub encasement. The tub may be a shower tub, a bathtub or also a whirlpool tub, to which the required installations are connected to the outer side.

2. The Prior Art

According to the prior art, a tub is embedded in a tub support made of foamed plastic material. Thin-walled plastic panels produced by deep drawing are used as tub encasements, such panels being connected with the tub support. A tub support in the form of a foam body is disadvantageous when complicated installations are required on the outer side of the tub, for example with a whirlpool tub.

Arrangements are also known in which a tub is arranged on feet and a tub encasement is provided on the outer side. The encasement consists of a support construction and thin-walled encasement elements secured on the support construction (DE-A 198 01 043). With this design, adequate installation space is in fact available between the tub and the tub encasement that can be used for accommodating the installations. However, the tub encasement requires much expenditure in terms of construction and has no sound absorption power. Body sound is transmitted without any damping. Knocks against the encasement, for example when the encasement is cleaned, are connected with annoying noise that is perceived also as a rattling or humming noise.

The invention addresses the problem of proposing a sound-damping tub encasement that offers adequate installation space for installations. In particular, the invention addresses installations on a whirlpool tub.

SUMMARY OF THE INVENTION

The invention solves this problem with a sanitary device comprising a tub arranged on feet, and a tub encasement. The tub encasement is structured in the form of a supporting construction unit whose structure is made up of panels. At least the panels that are visible in a room consist of a hard integral polyurethane foam material and have a decorative coating. For components of the tub encasement that border directly on a wall of the room, other panel materials such as, for example Styropor panels can be used as well. However, the components of the encasement are preferably made of hard integral polyurethane foam material. Panels that adjoin a wall of the room and are not visible need not have any decorative coating.

The panels produced in the form of hard integral foam material elements may have complicated shapes. In addition to providing their front side with aesthetically pleasing designs, reinforcing ribs may be molded to the inside of the front sides for enhancing the dimensional stability. Owing to the cellular structure, which may still be present even in molded panels that are relatively massive, the tub encasement as defined by the invention not only forms a frame supporting the tub, but also has good absorption power for body sound. The panels may have a density of from 200 to 800 kg/m$^3$, preferably a range of up to about 600 kg/m$^3$. The panels or molded components may be coated with an opaque lacquer. However, the decorative coating of the panels preferably consists of a plastic sheet.

The tub encasement as defined by the invention supports the tub against tilting. The arrangement comprising the tub encasement and the tub can be transported as a mobile sanitary device that has been pre-assembled by the manufacturer. The device is then set up in an otherwise completely furnished bathroom and connected there very quickly to the installations already available on the building side by just a few manipulations. The tub can be lifted from the tub encasement; however, its position within the tub encasement is fixed. According to a preferred embodiment of the invention, the position of the tub is fixed by means of holding means that are plugged to the top edge of at least one panel arranged on the side of the wall. The holding means have legs on their top sides. One leg of the holding means engages an angled ledge of the tub from behind. Another leg arranged parallel therewith extends as a spacer into a gap between the ledge of the tub and the adjacent wall. The holding means can be screwed to the wall, whereby the surface of the holding means abutting the wall on the wall side is preferably provided with elements for absorbing sound. Extensive absorption of sound can be achieved, for example if the contact of the holding means with the wall is limited to sites contact in the form of lines or points. However, elastomeric sound damping elements can be employed for absorbing sound as well. The holding means are usefully provided with fastening legs located on their undersides, which engage the top edge of the panels in the form of a "U".

The panels can be joined with each other in the form of a frame by means of fittings located on their insides, for example in the form of hinges or angles. In a preferred embodiment, at least one panel accessible to the room is detachably connected by fittings to the adjacent panels of the tub encasement. The fittings consist of fitting components that can be interlocked with each other. The respective accessible panel usefully can be removed for installation and inspection purposes. The front panel extending over the length of the tub is usefully designed as the removable panel. Furthermore, the joints of the panels are usefully shaped in the form of bevels.

In a further development, one panel located on the side of the wall has a lesser height than a front side panel that is visible in the room. The shorter panel is supported on feet forming a free installation space. The inner space between the tub encasement and the tub is accessible owing to such free installation space. This installation space can be used for laying connection lines leading to installations on the side of the building. It is understood that in addition recesses may be located in the back wall of the tub encasement.

For compensating tolerances, a sealing lip is usefully arranged on the top edge of the tub encasement, such sealing lip resting against the underside of the ledge of the tub. Furthermore, the top edge of the panels can be provided with a cover strip that is arranged in front of the ledge of the tub. The cover strip is usefully molded onto the ledge, forming one piece jointly with the ledge, and provided with the decorative coating of the panel.

In practical life, the ledge of sanitary tubs is frequently provided with rounded corners. With large radii of the rounding, gussets may be formed in the corner areas of the tub encasement that have to be sealed. Sealing with the usually employed sealing compounds may be visually unsatisfactory. In an advantageous embodiment, corner filling pieces are connected to the ledge of the tub. These corner filling pieces have contact surfaces which are adapted to the rounded corners of the ledge of the tub. Such corner fillers cover in the corner zones of the tub encasement the gussets between the ledge of the tube and the panels that are joined with each other at an angle. The corner filling pieces can be glued to the ledge of the tub and are visually adapted to the surface of the sanitary tub.

BRIEF DESCRIPTION OF THE DRAWINGS

The invention is explained in the following description with, the help of the drawings showing an exemplified embodiment of the invention, in which.

DETAILED DESCRIPTION OF PREFERRED EMBODIMENTS

Figure 1:
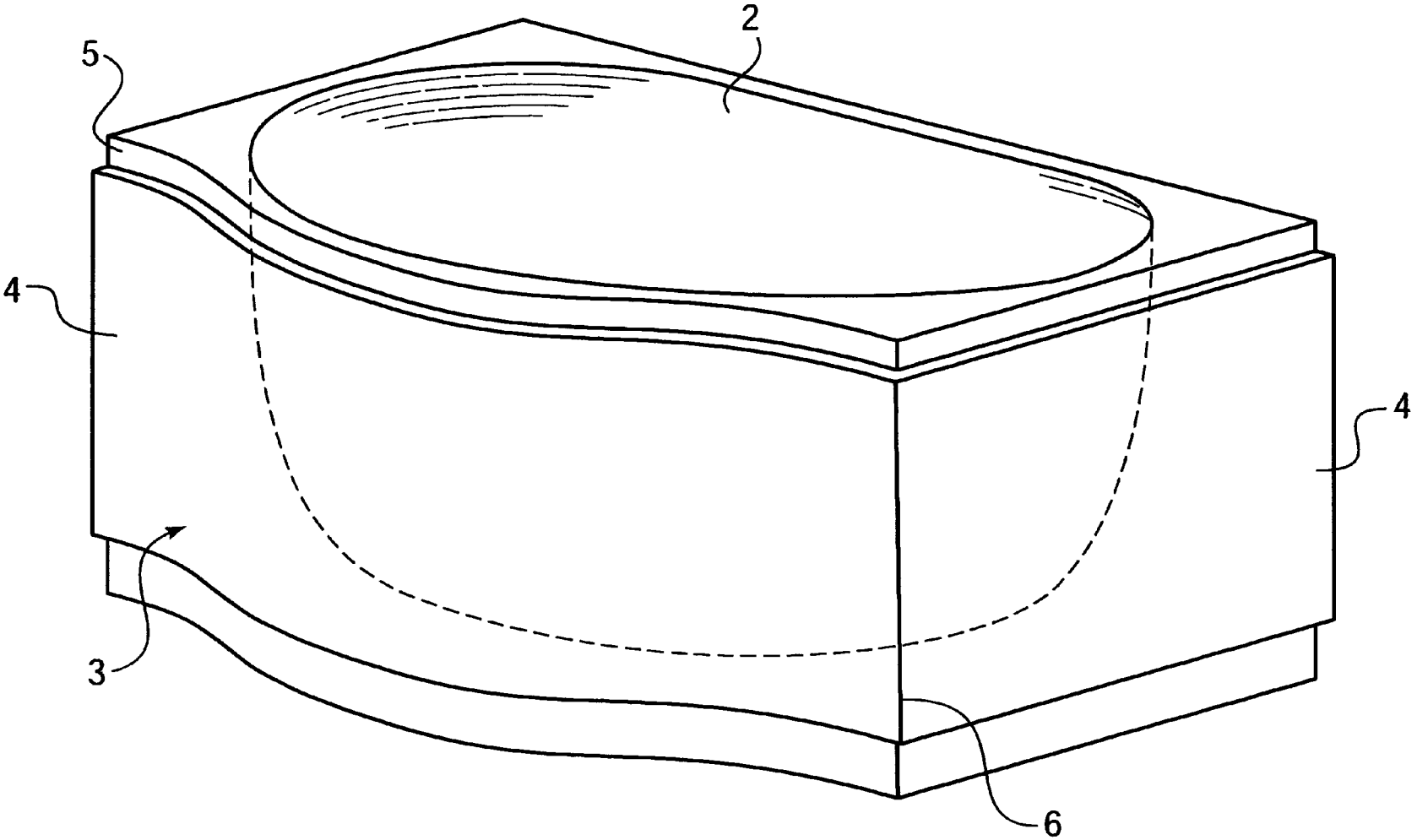
FIG. 1 is a perspective view of a sanitary device comprising a tub and a tub encasement as defined by the invention.
Figure 2:
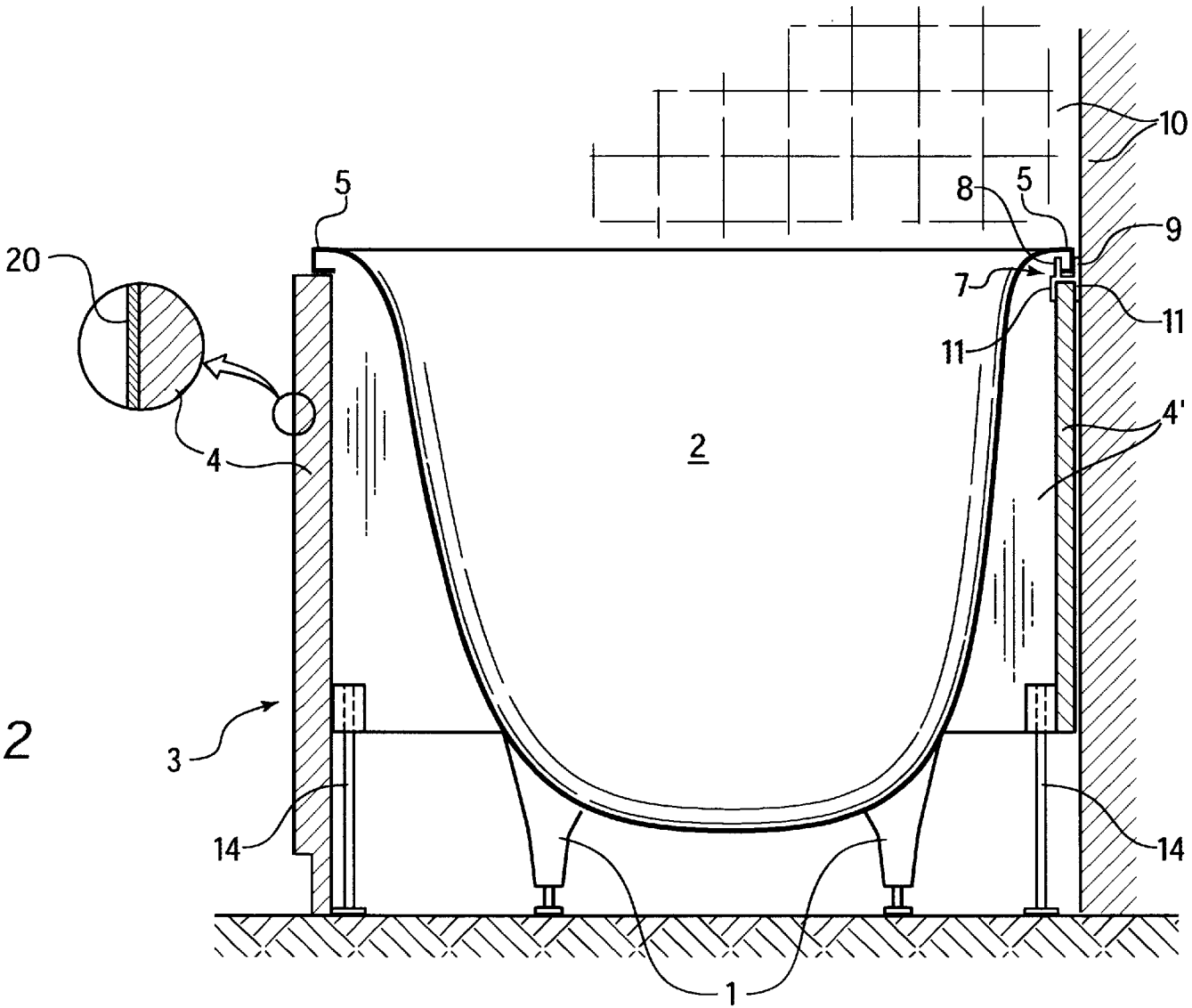
FIG. 2 is a section through the embodiment shown in FIG. 1.
Figure 3:
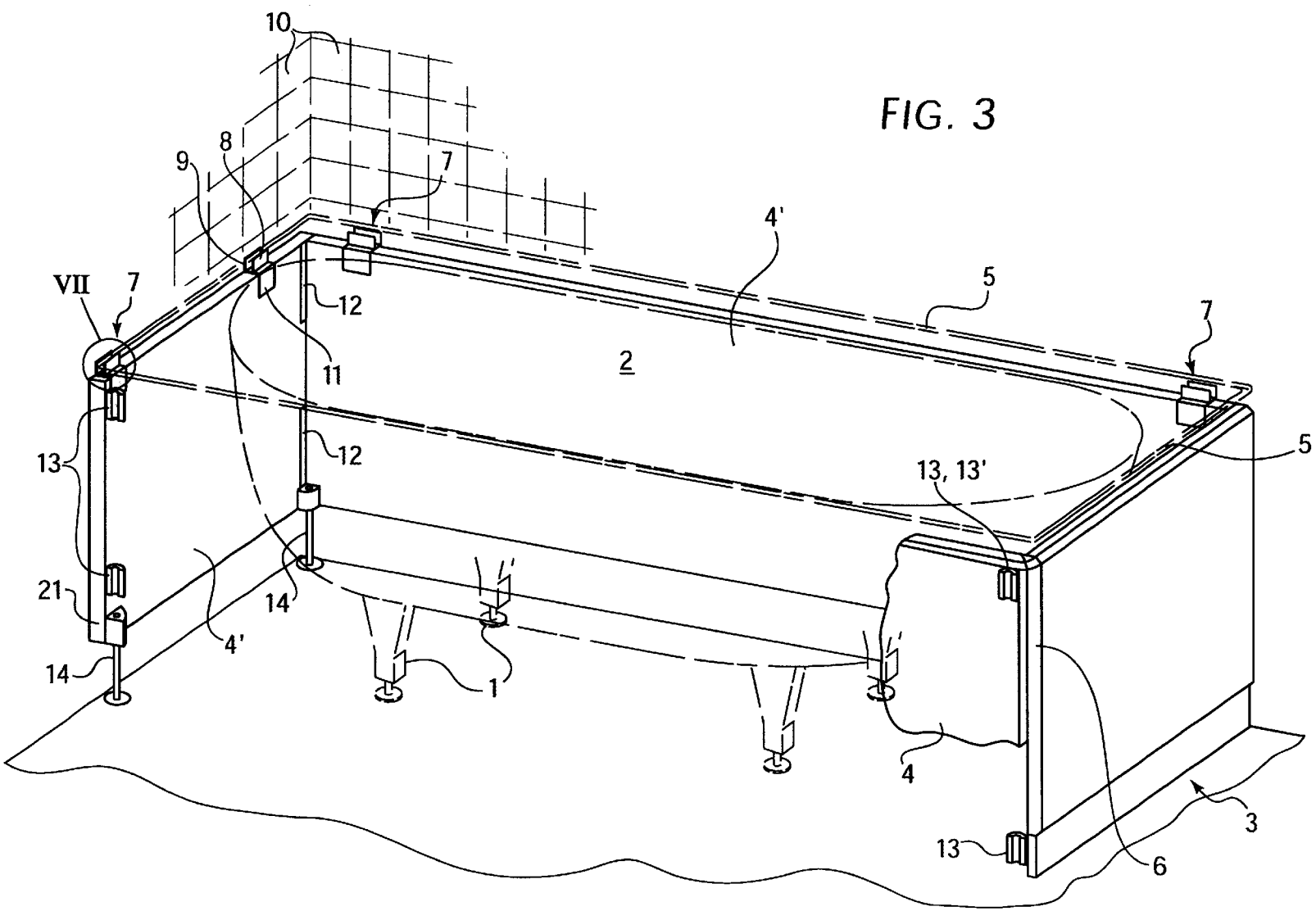
FIG. 3 shows a perspective view of another embodiment of the sanitary device as defined by the invention, with the tub encasement partially removed.

FIGS. 1–2 show the basic structure of the sanitary device. The device comprises a sanitary tub 2 arranged on feet 1 and a tub encasement 3 forming a supporting construction. The structure of the tub encasement 3 is made up of the panels 4 and 4', which are made of a hard integral polyurethane foam material. At least the panels 4 that are visible in the room have a decorative coating. The panels 4, 4' take the form of molded components and have a density of from 200 to 800 kg/cubic meter. A range of up to 600 kg/cubic meter is preferred. The molded components have a cellular structure that is capable of absorbing body sound. A free installation space remains available between the tub 2 and the tub encasement 3. FIG. 3 shows that this free space can be used for installations. Installations for a whirlpool tub, for example, can be readily accommodated in this space as well. The joined edges of the panels can be designed in the form of beveled edges 21, which results in a joint 6 as shown in FIG. 1. The decorative coating of the panels preferably consists of a plastic sheet 20 shown in the cutout in FIG. 2. Other types of coatings, however, may be used.

Figure 7:
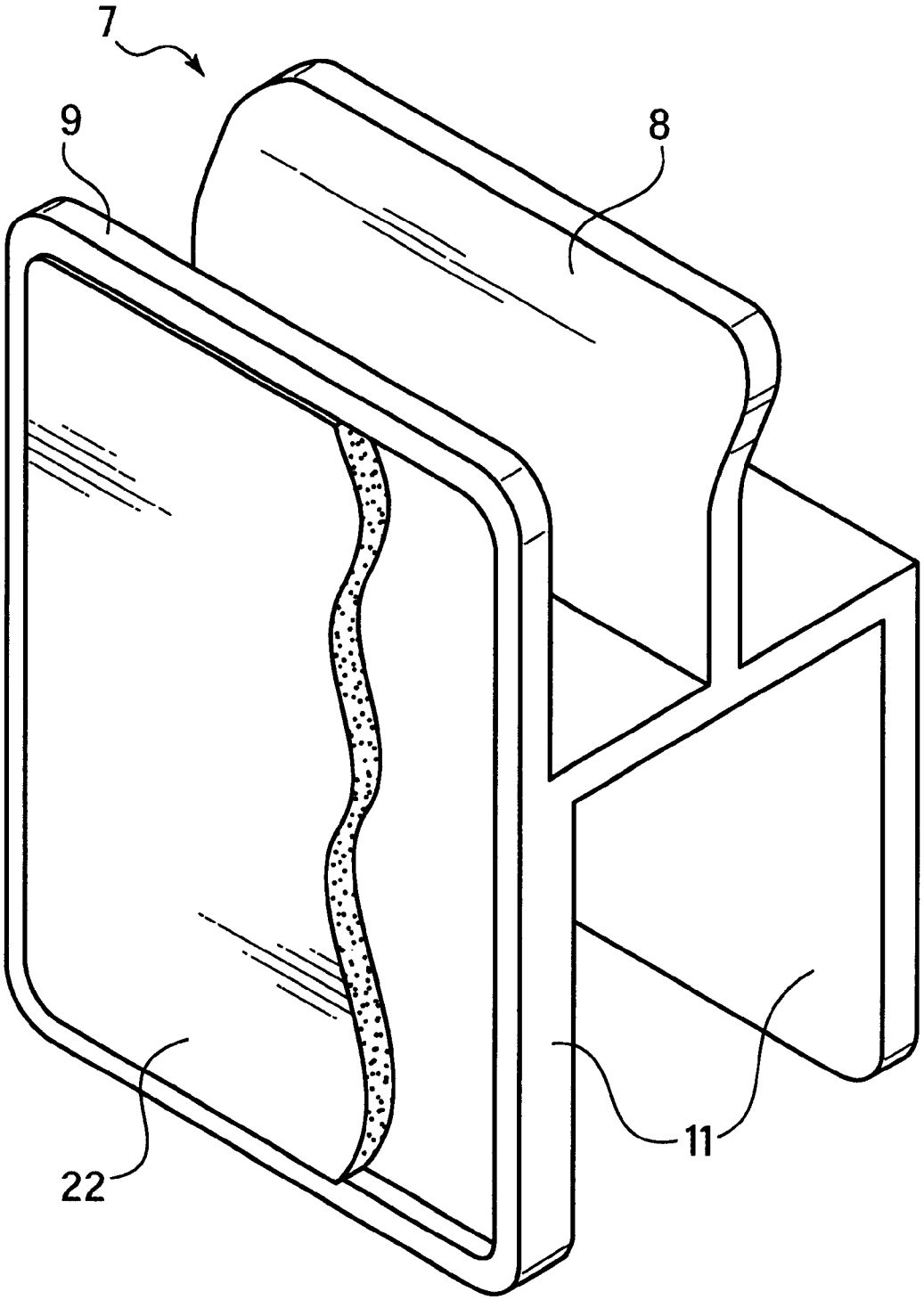
FIG. 7 shows an enlarged representation of area VII in FIG. 3.
Figure 8:
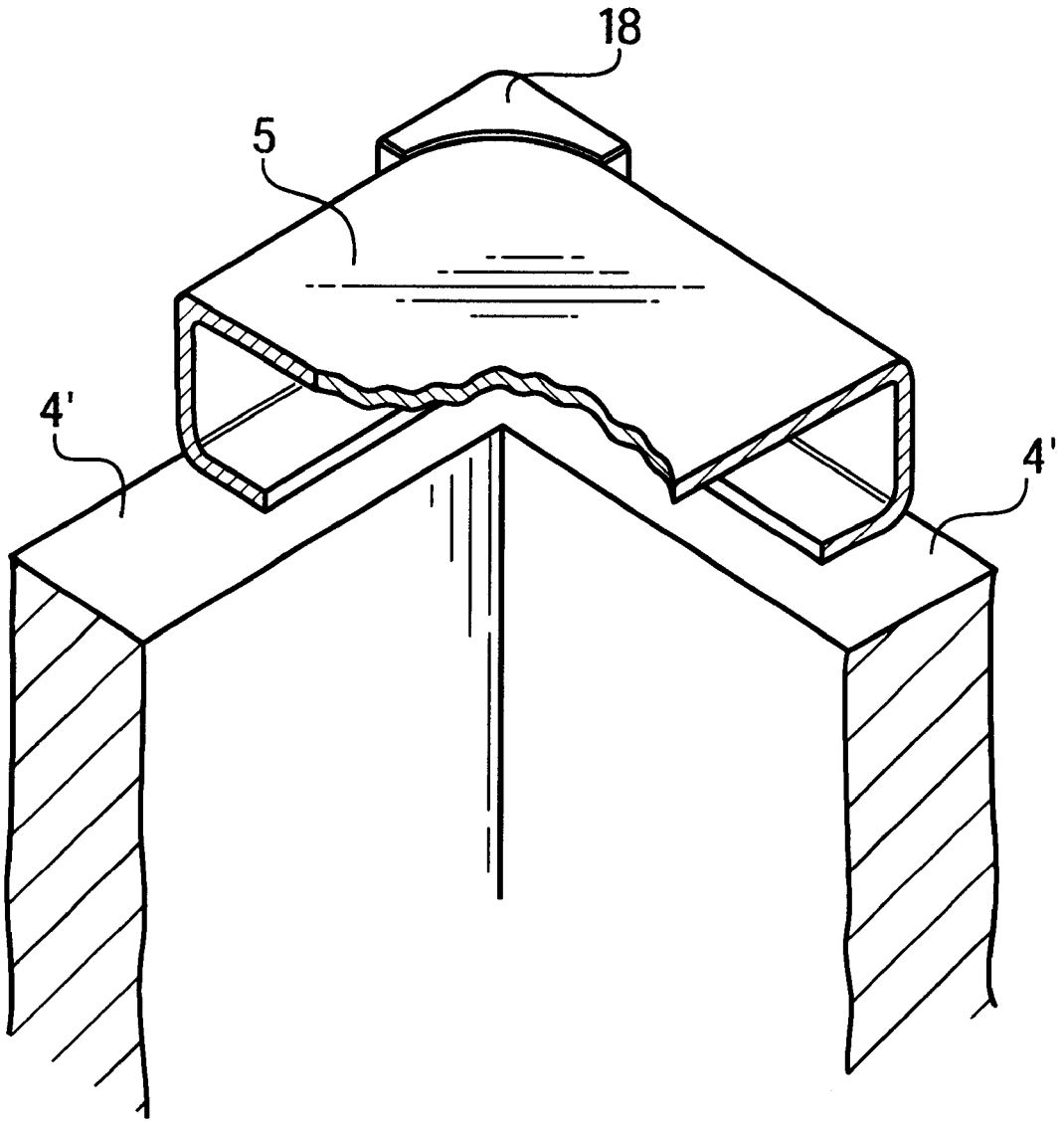
FIG. 8 shows a corner filling piece connected to the tub ledge and covering the gussets.

The tub 2 can be lifted from the tub encasement 3 upwards; however, it cannot slip around within the tub encasement 3. For fixing the position of the tub, the holding means 7 are plugged to the top edge of at least one panel 4' located on the side of the wall. The holding means have the legs 8, 9 located on their top sides. In particular, as shown by FIG. 2, one leg 8 engages an angled ledge of the tub 2 from behind. Another parallel arranged leg 9 extends as a spacer into a gap between the tub ledge 5 and the adjacent wall 10, for example a tiled wall of the bathroom. The holding means 7 can be screwed to the wall 10. The contact surface of the holding means facing the side of the wall can be provided with elements for absorbing sound 22 shown in FIG. 7. On their undersides, the holding means 7 are provided with fastening legs 11, which frame the top edges of the panels in the form of a "U". Panels 4, 41 are joined with each other in a frame-like manner by means of the fittings 12 located on the inner sides. Fittings 12 can take the form of hinges, angles, or plug connectors as in the exemplified embodiment. The panel on the front side, which is readily accessible from inside the room, can be removed for installation and inspection purposes. The panel is detachably connected with the adjacent panels of the tub encasement by fittings comprising fitting components 13, 13', which can be interlocked with each other.

As shown in FIGS. 2 and 3, in the exemplified embodiment, the panels 4' associated with a wall are designed with a longitudinal side and a front side having a lesser height than the panels 4 that are visible in the bathroom. Panels 4' on the wall side are supported on feet 14, which form a vacant space available for installations.

Figure 4:
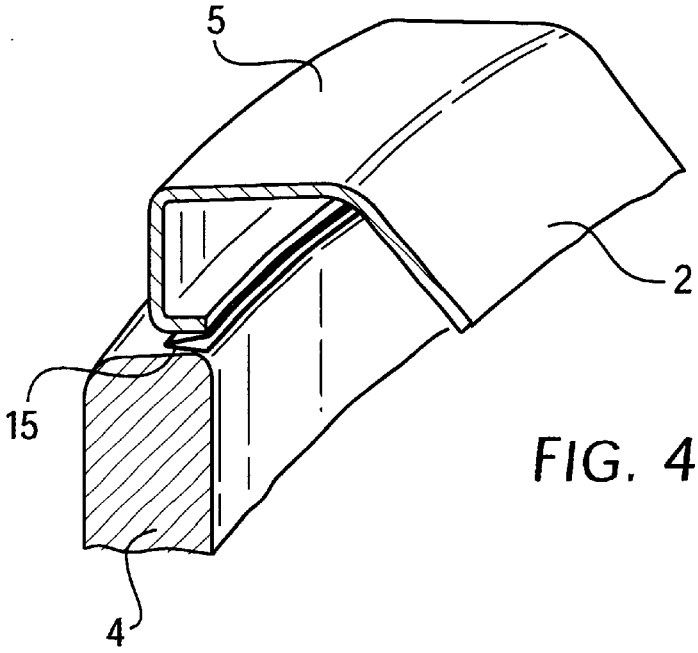
FIGS. 4 and 5 show in the form of cutouts other embodiments of the sanitary device as defined by the invention.
Figure 5:
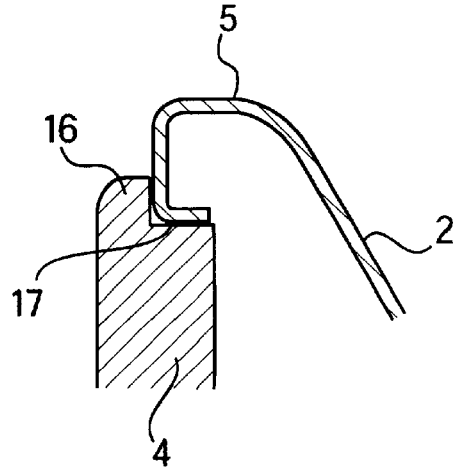

A sealing lip 15 resting against the ledge of the tub may be arranged on the upper edge of tub encasement 3 (FIG. 4). For appearance purposes, furthermore, the upper edges of panels 4 that are visible in the room, may be provided with a cover strip 16 arranged in front of the ledge of the tub. The cover strip covers from view a joint 17 between the tub ledge 5 and the panels 4 (FIG. 5).

Figure 6:
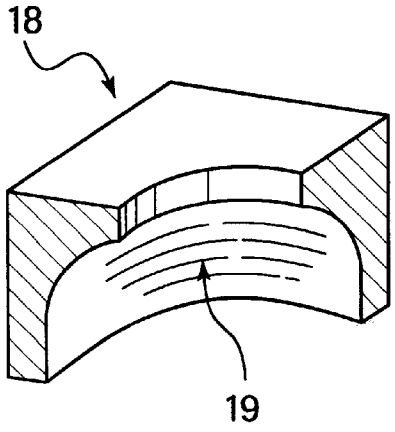
FIG. 6 shows a corner filling piece for connection to the sanitary device as defined by the invention.
Figure 9:
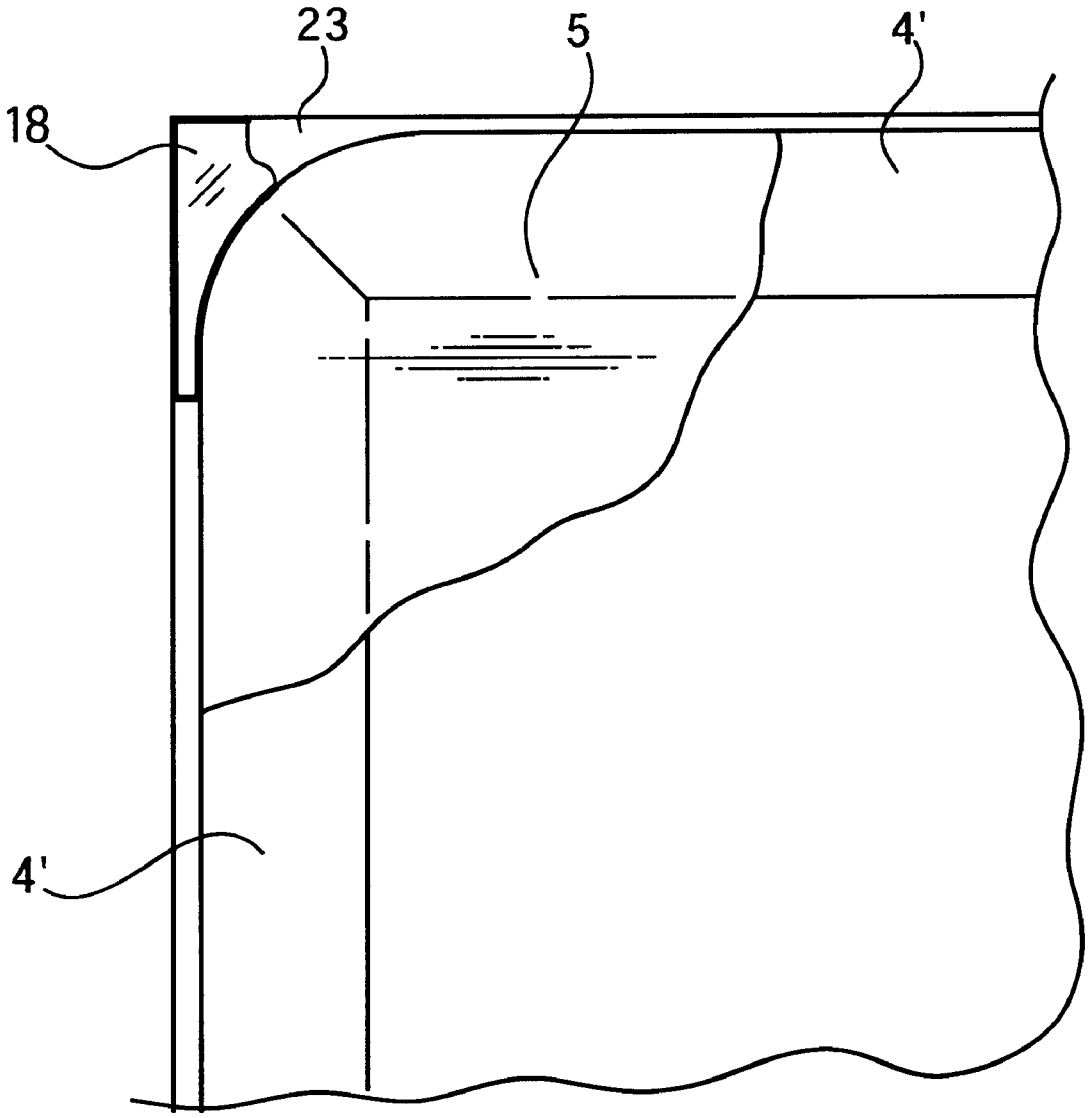
FIG. 9 shows the corner filling piece of FIG. 8 concealing the gussets.

The tub ledge 5 of a sanitary tub frequently has rounded corners. With large radii of such rounded corners, gussets 23 may be formed in the corner areas of the tub encasement between the panels 4, 4', the panels being joined with each other at an angle, and the tub ledge 5. Such gussets have to be sealed against the penetration of moisture. FIG. 6 shows a corner filling piece 18 that has a contact surface 19 which is adapted to the corners of the ledge of the tube. This corner filling piece can be glued to tub ledge 5. As shown in FIG. 9, corner filling pieces 18 cover the gussets 23 resulting between tub ledge 5 and panels 4, 4'—which are joined with each other at an angle. Corner filling pieces 18 also have a surface design compatible with the surface of sanitary tub 2 particularly with respect to color.

Accordingly, while a few embodiments of the present invention have been shown and described, it is to be understood that many changes and modifications may be made thereunto without departing from the spirit and scope of the invention as defined in the appended claims.

What is claimed is:

1. A sanitary device comprising:

(a) a tub arranged on feet having an angled ledge adapted to be positioned to form a gap between said ledge and an adjacent room wall;

(b) a tub encasement on an outer side of said tub, said encasement comprising a supporting structure formed from a plurality of panels, at least some of said plurality of panels comprising a hard integral polyurethane foam material and at least one panel having a top edge and being adapted to face the adjacent room wall; and (c) holding means secured to the top edge of said at least one panel for fixing the tub within said tub encasement, said holding means comprising:

(i) first and second parallel legs, said first leg engaging the angled ledge of said tub from behind and said second leg extending as a spacer in the gap between the tub ledge and the adjacent room wall; and (ii) downwardly extending fastening legs in the form of an inverted "U" for clamping onto the top edge of said at least one panel.

2. The sanitary device according to claim 1, wherein the integral foam material has a density of from 200 to 600 $kg/m^3$.

3. The sanitary device according to claim 1, wherein said at least some of said plurality of panels are coated with a plastic sheet.

4. The sanitary device according to claim 1, wherein the holding means has a contact surface provided with elements for absorbing sound.

5. The sanitary device according to claim 1, wherein:

(a) said plurality of panels have inner sides; and (b) the device further comprises fittings on the inner sides connecting said plurality of panels to form the supporting structure.

6. The sanitary device according to claim 1, further comprising fittings comprising fitting components interlockable with one another, said fittings detachably joining at least one panel of said plurality of panels with adjacent panels.

7. The sanitary device according to claim 1, wherein said plurality of panels have beveled joints.

8. The sanitary device according to claim 1 wherein the tub encasement further comprises a top edge having a lip resting against the tub ledge.

9. The sanitary device according to claim 1 wherein the top edge of each panel has a cover strip located in front of the tub ledge.

10. The sanitary device according to claim 1 wherein (a) the tub ledge has rounded corners;

(b) the tub encasement has corner areas;

(c) said plurality of panels are joined with each other at an angle; and (d) the device further comprises gussets formed in the corner areas of the tub encasement between the tub ledge and the panels and corner filling pieces connected to the tub ledge corresponding to said gussets, each of said corner filling pieces having a contact surface adapted to a respective rounded corner of the tub ledge and covering the corresponding gusset.

11. A sanitary device comprising:

(a) a tub arranged on feet; and (b) a tub encasement on an outer side of said tub, said encasement comprising a supporting structure formed from a plurality of panels, at least some of said plurality of panels comprising a hard integral polyurethane foam material, said plurality of panels including:

(i) a first panel on a front side of said encasement adapted to be visible from a room in which the device is situated; and (ii) a second panel on said encasement adapted to face an adjacent room wall, the second panel having a lesser height than the first panel and being supported on feet to form a free installation space.

* * * * *